US007134224B2

(12) United States Patent
Elkington et al.

(10) Patent No.: US 7,134,224 B2
(45) Date of Patent: Nov. 14, 2006

(54) LACED BOOT

(75) Inventors: Mark Elkington, Tuen Mun (HK); Ralph Kohler, Oberperfuss (AT)

(73) Assignee: Goodwell International Ltd. (British Virgin Islands), Tortola (VG)

( * ) Notice: Subject to any disclaimer, the term of this patent is extended or adjusted under 35 U.S.C. 154(b) by 163 days.

(21) Appl. No.: 10/795,197

(22) Filed: Mar. 5, 2004

(65) Prior Publication Data

US 2004/0226190 A1 Nov. 18, 2004

(30) Foreign Application Priority Data

Mar. 12, 2003 (DE) ..... 103 11 175

(51) Int. Cl.
*A43C 11/00* (2006.01)

(52) U.S. Cl. ..... 36/50.1; 36/50.5; 36/117.1

(58) Field of Classification Search ..... 36/50.1, 36/50.5, 117.1, 88

See application file for complete search history.

(56) References Cited

U.S. PATENT DOCUMENTS

| | | | | |
|---|---|---|---|---|
| 459,616 | A | 9/1891 | Rohonczy | |
| 2,660,812 | A | 12/1953 | Henke | |
| 4,724,626 | A * | 2/1988 | Baggio | 36/117.8 |
| 4,811,503 | A * | 3/1989 | Iwama | 36/118.1 |
| 4,984,375 | A * | 1/1991 | Bonnet | 36/117.8 |
| 5,291,671 | A * | 3/1994 | Caberlotto et al. | 36/88 |
| 5,408,761 | A | 4/1995 | Gazzano | |
| 5,499,461 | A | 3/1996 | Danezin et al. | |
| 5,682,654 | A * | 11/1997 | Crowley et al. | 24/714.9 |
| 6,286,233 | B1 * | 9/2001 | Gaither | 36/50.1 |
| 6,637,130 | B1 * | 10/2003 | Urie et al. | 36/11.5 |
| 2002/0095750 | A1 | 7/2002 | Hammerslag | |

FOREIGN PATENT DOCUMENTS

| | | |
|---|---|---|
| DE | 1675440 U | 4/1954 |
| DE | 659 13 805 T2 | 2/1994 |
| DE | 298 14 659 U1 | 8/1998 |
| EP | 0 057 170 A2 | 1/1982 |
| EP | 272 643 A | 6/1988 |
| EP | 0 474 708 B1 | 5/1990 |
| EP | 0 646 334 A1 | 9/1994 |
| EP | 0 705 544 B1 | 1/1999 |
| EP | 0 746 214 B1 | 12/1999 |
| FR | 49631 | 5/1939 |
| WO | WO 95/22917 A | 8/1995 |
| WO | WO 99/09850 A1 | 3/1999 |

OTHER PUBLICATIONS

Hüthig: Lexikon der Schuhtechnik, Leipzig, VEB Fachbuchverlag, 1983, pp. 403 & 454.

* cited by examiner

*Primary Examiner*—Marie Patterson
(74) *Attorney, Agent, or Firm*—Senniger Powers

(57) ABSTRACT

A laced boot having a boot lace and sections of the boot lace run in a continuous one-piece manner as follows: a first section runs from the metatarsal area of the sole over the instep of the boot; a second section runs from the metatarsal area of the sole around the outside of the upper above a heel area of the boot; and a third section runs from the same position of the upper to the instep and back to the cited position of the upper and the three named sections form a triangle, viewed from the side of the boot that covers the ankle joints of the foot.

10 Claims, 7 Drawing Sheets

LACED BOOT

FIELD OF THE INVENTION

The invention pertains to a laced boot.

BACKGROUND OF THE INVENTION

Laced boots such as snowboard boots, inline skate boots, hiking boots, mountain-climbing boots, etc. are laced by a boot lace threaded through several deflection elements such as, e.g., eyelets on two opposite tabs of the boot and the ends of the boot lace are fixed either by a lacing or by a holding and/or clamping device. Such a laced boot is known from EP 0 474 708 B1, WO 99/09850 A1 and DE 298 14 659 U1.

Most laced boots and in particular snowboard boots are made of flexible material, which provides comfort and also allows a relatively great mobility of the user's foot which is especially desirable in the case of snowboarding. On the other hand, the connection between foot, boot and snowboard must be so firm that the rider can transfer the necessary forces onto the snowboard, especially onto its front and back edges. In order to achieve this, it would actually be necessary to made the boot upper relatively stiff for movements to the front and to the rear, relative to the longitudinal direction of the boot; however, this would limit the comfort, especially when walking.

Another requirement for a good seat of the boot and therewith a good transfer of force during snowboarding onto the front edge is a good heel hold of the foot in the boot. In other words, in particular the heel area of the foot should also rest on the inner side of the sole of the boot when the rider bends his ankle joint forward in order to transfer forces onto the front edge of the snowboard.

EP 0 705 544 B1 suggests to this end that a tightening strap with low expandability in the longitudinal direction be provided for lacing that runs from the instep area of the boot to the heel area and thus presses the heel down and to the rear. In addition, another tightening strap is provided that runs from the front area of the foot around the upper of the boot and thus supports the flexible upper from bending to the rear.

Similar tightening straps are also known from FR 49631, EP 0 646 334 A1, EP 0 057 170 A2, U.S. Pat. Nos. 2,660,812 A, 5,408,761 A, 5,499,461 A and 459,616 A.

U.S. Pat. No. 5,291,671 A shows a laced boot comprising a circumferential cable in addition to the traditional lacing which cable runs from the metatarsal area of the foot through the boot sole and from there on both sides around the boot upper. This cable forms loops in the instep area at which it can be tightened.

However, such additional tightening straps necessitate a greater industrial expense and have the disadvantage in practice that the user, in order to have a good hold, tightens so strongly that the circulation in the foot is adversely affected. This also has an adverse effect on the comfort and increases the danger of an accident. Moreover, in addition to the tightening of the laces one or several tightening straps must also be tightened in further work steps.

EP 0 746 214 B1 shows a low shoe with a shoelace that runs starting from the sole area over the upper part of the shoe and also has a section that runs from the sole area around the heel area and has a section running from the heel area approximately horizontally to the instep area. Finally, a section is also provided that runs from the instep area to the heel area near the sole so that the three cited sections form a triangle when viewed from the side in which, however, the upper, substantially horizontal section is located beneath the ankle of the foot and thus beneath the ankle joints of the foot. Such a lacing is therefore not suitable for a boot with an upper surrounding part of the shinbone of the user.

SUMMARY OF THE INVENTION

The invention addresses the problem of improving the laced boot of the initially cited type in such a manner that a good hold of the foot is assured in the boot along with simple manipulation and good comfort and in particular a good heel hold.

This problem is solved by the features indicated in claim 1. Advantageous embodiments and further developments of the invention can be gathered from the subclaims.

The basic principle of the invention is to guide the boot lace in such a manner that the forces necessary for a good hold are applied only by the boot lace. To this end the boot lace is guided in such a manner that sections of the boot lace run as follows:

a) A first section runs from the metatarsal area of the sole over the instep area;

b) A second section runs from the metatarsal area of the sole around the outside of the upper at a level in the area of or above the area of the upper ankle joint of the foot; and c) A third area runs from the same location on the upper to the instep and back to this location of the upper.

All of these cited sections are a one-piece component of the boot lace. They clamp an approximate triangle, viewed from the side, in which, again viewed from the side, the ankle joints and the ankles of the foot are located.

The boot lace is preferably tightened by a tightening mechanism like the one known, e.g., from U.S. Pat. No. 2002/0095750 A1. This is a winding mechanism with a ratchet on whose winding mandrel both ends of the boot lace are wound. The boot lace is preferably a thin wire rope with high tensile strength and low bending resistance that can be easily wound on a winding mandrel with a small diameter.

The one-piece design of the boot lace also has the advantage that during certain movements of the foot certain sections of the boot lace are automatically tightened. If, for example the upper is bent forward, the above-cited second section becomes longer, which automatically entails a shortening of the first and of the third section so that as a result the heel is pressed more strongly downward and to the rear during an intensified frontal position and therewith pressure on the front edge of the snowboard.

In order to form the above-cited three sections, three guidances are possible. Thus, the first and the second section can run in the metatarsal area of the sole on both sides over a deflection; however, they can also run through the sole to the other side and be guided, e.g., in the sole in casings that cross over each other in the inside of the sole in an exemplary embodiment.

A further development of the invention can provide that a few or all of the cited three sections are guided in flexible casings for protecting the outside of the boot, e.g., in wound spiral springs or a jacket of a known Bowden cable. Note for clarification that the one-piece design of the boot lace refers to the above-cited three sections. Other sections of a traditional lacing in which opposite lateral boot straps are drawn onto each other can alternatively either be designed in one piece with the three cited sections or be guided as a separate boot lace or separate boot laces.

BRIEF DESCRIPTION OF THE FIGURES

The invention is described in detail in the following with reference made to exemplary embodiments in conjunction with the drawings.

DETAILED DESCRIPTION OF PREFERRED EMBODIMENTS

This application claims priority from German application 103 11 175.1, filed Mar. 12, 2003, the entire disclosure of which is expressly incorporated herein by reference.

Figure 1:
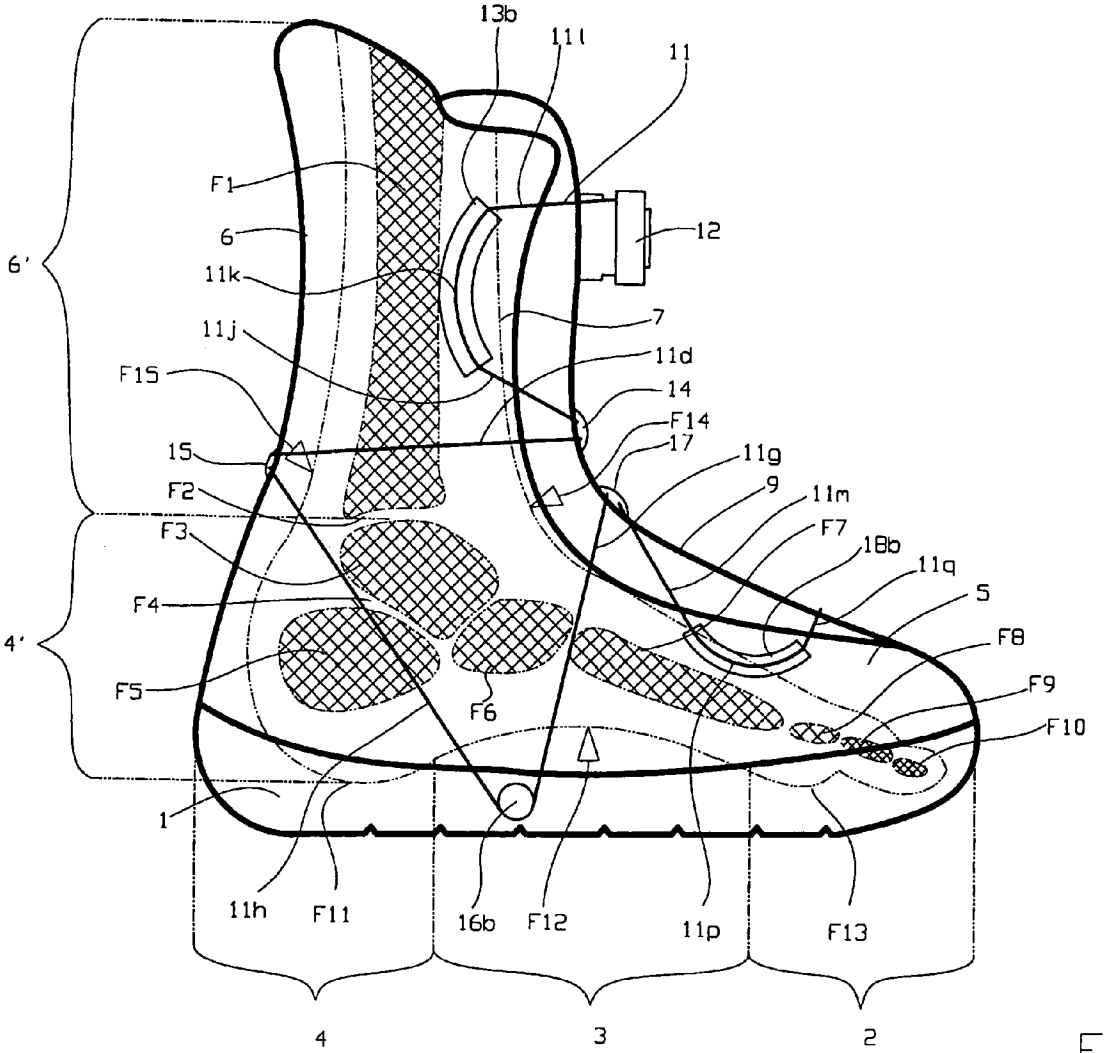
FIG. 1 shows a schematic side view of an exemplary embodiment of a laced boot in accordance with the invention and shows a foot.

FIG. 1 is referred to at first, in which a foot F is schematically shown in a side view. The essential bones of the foot are shinbone F1 to which anklebone F3 is connected via upper ankle joint F2, followed, from the top downward, by heel bone F5 via lower ankle joint F4. Following lower ankle joint F4 the foot consists via navicular bone F6 and metatarsal bone F7 of toe bones, namely, a base toe member F8, a middle toe member F9 and a terminal toe member F10. Joints are also present between the last-named bones but are not shown. In the area of the foot sole a heel area F11 can be distinguished located below heel bone F5 and convexly curved to the outside in a lateral view, a metatarsal area F12 located below navicular bone F6 and below metatarsal bone F7 and concavely curved inward as well as a front foot area F13 with the ball of the foot and the toes.

For the purpose of the later description of the boot, reference is made to an instep area F14 that is located on the upper front side of the foot approximately at the level of the two ankle joints F2, F4 as well as to an upper heel area F15 that is located on the back side of the foot in the area of the upper ankle joint and at which the side contour merges from the convex area of the heel and ankle joints to an area of the calf that is concave at first. The individual muscles and tendons are not shown for the sake of better clarity.

Figure 4:
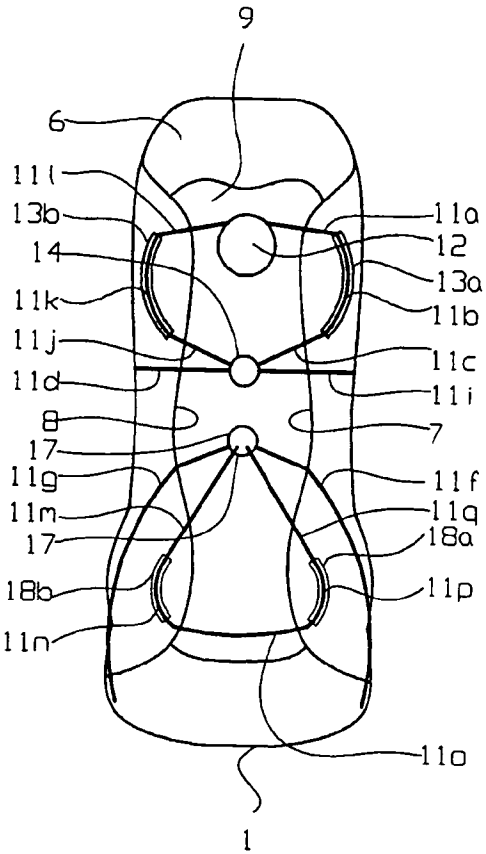
Figure 6:
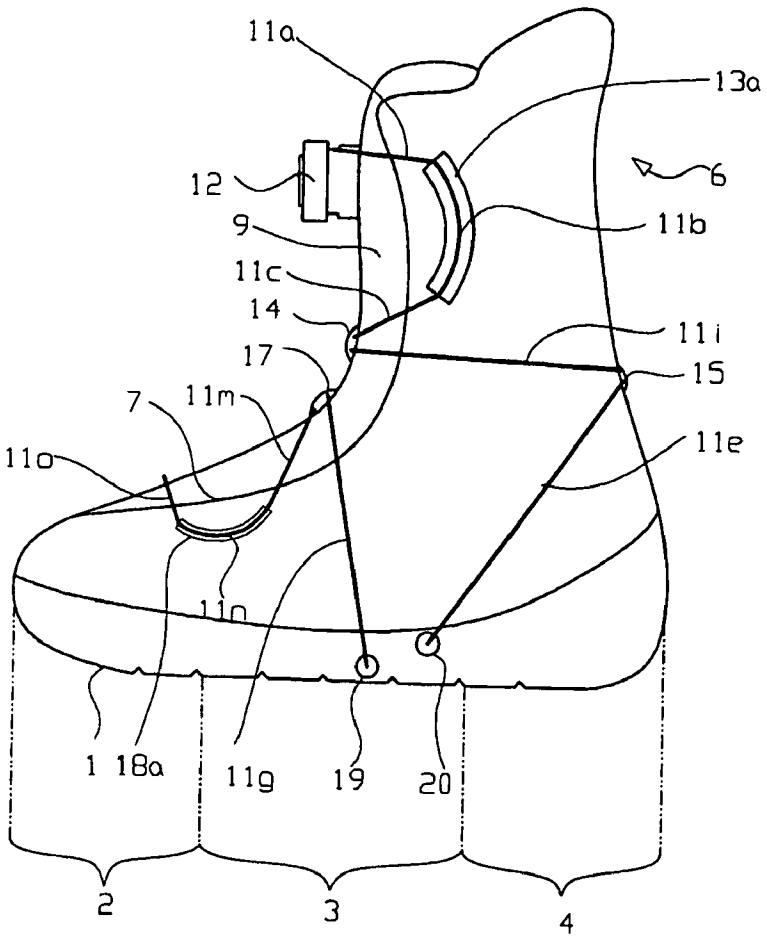
FIGS. 6–10 show a side view from the left, a rear view, a front view, a side view from the right and a view of the bottom of a laced boot according to a second exemplary embodiment of the invention.
Figure 7:
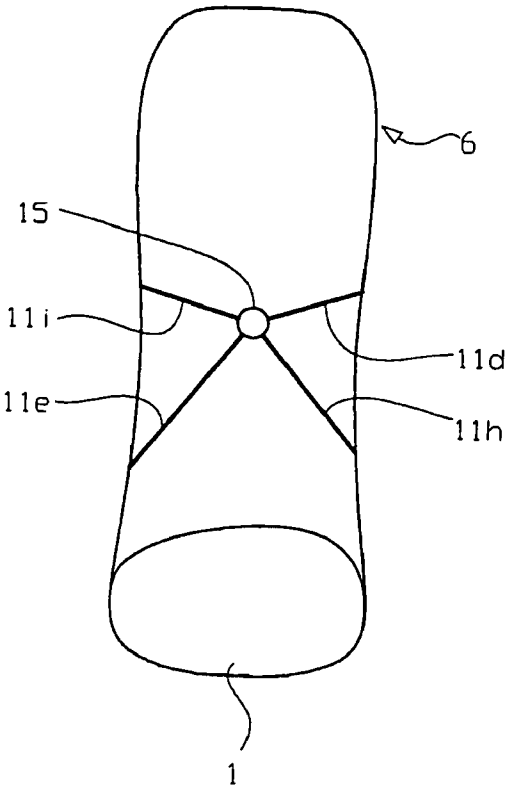
Figure 9:
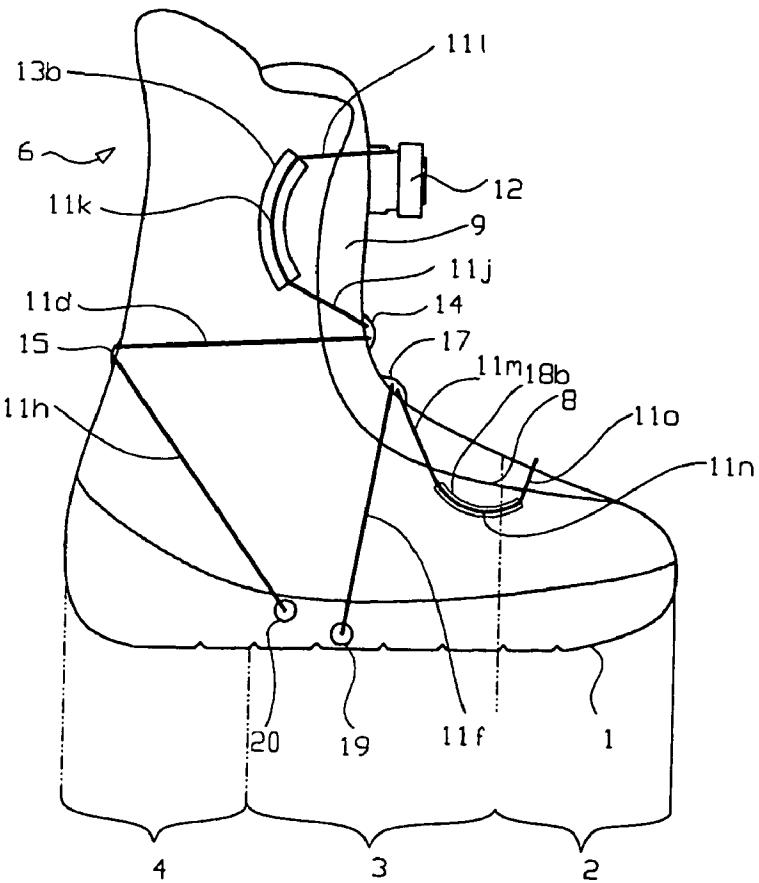
Figure 8:
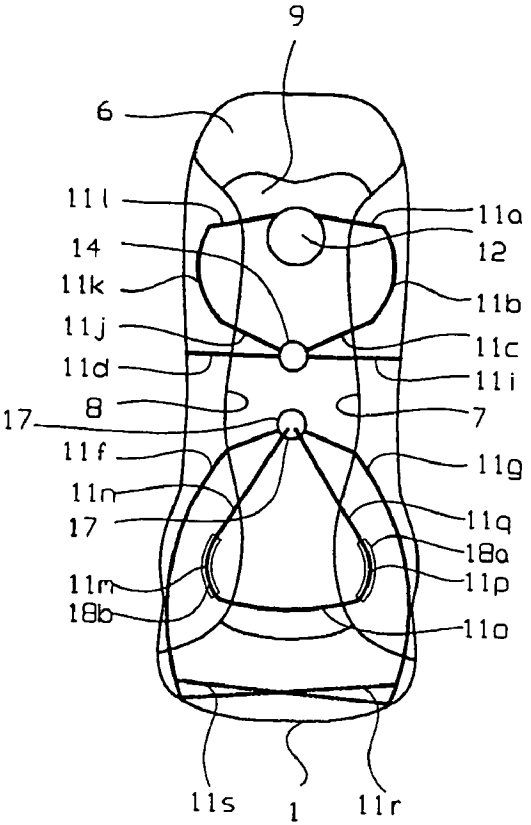
Figure 10:
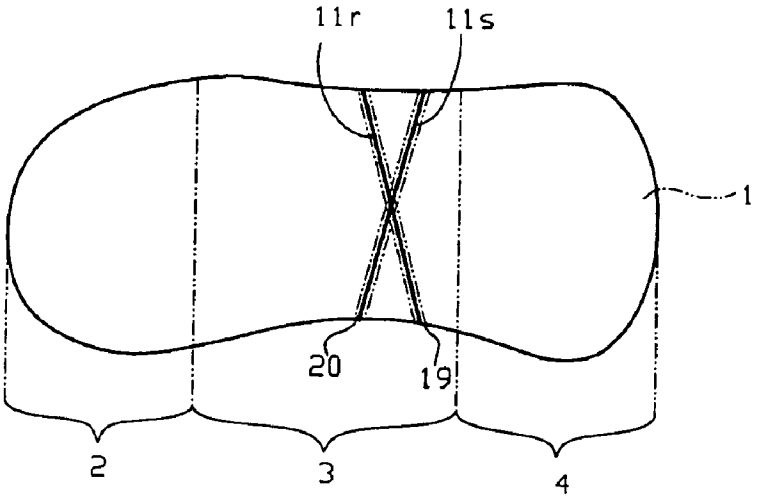

It is particularly important for a good hold of the foot in the boot, for heel area F11 to be in constant contact with the inner side of sole 1 of the boot, but this is a problem in most boots. Sole 1 is subdivided in accordance with the upper division of the foot areas likewise into a front foot area 2, a metatarsal area 3 and a heel area 4. An area designated with 4' and extending from heel bone F5 upward to upper ankle joint F2 is also designated as heel area. An upper 5 encircling the foot and to which leg 6 extending vertically upward is connected is attached in a known manner to sole 1. Leg 6 is defined here in such a manner that it is connected at the level of upper ankle joint F2 to upper 5 and covers a substantial area of shinbone F1. This area is represented in FIG. 1 as shinbone area 6'. Upper 5 and leg 6 form flaps 7, 8 (see also FIGS. 4, 8) that are located at a distance from one another and between which a so-called tongue 9 is located. These flaps 7, 8 are drawn to each other by a lacing in order that upper 5 and leg 6 make close contact around the foot and hold it well in the boot.

In the invention the lacing consists of a one-piece continuous boot lace 11 guided in a special manner in order to assure the required good hold. Boot lace 11 is, in general terms, a traction member that is flexibly elastic but allows only a very low expansion in the longitudinal direction. It can be a traditional boot lace consisting of textile fibers or plastic fibers and can also be a wire cable. Boot lace 11 is fastened by its two ends to winding mechanism 12 attached for its part in the upper area of tongue 9. The winding of winding mechanism 12 causes both ends of boot lace 11 to be wound onto a winding mandrel (not shown), which shortens the active length of the boot lace. Winding mechanism 12 comprises a locking device with which the winding mandrel can be stopped and comprises a loosening device for loosening the boot lace. A winding mechanism of this type is described, e.g., in U.S. Pat. No. 6,289,558 B1 and therefore does not have to be explained in detail here. Of course, other known means and devices for locking the ends of a boot lace can also be used, whether they are a simple knot or other known clamping devices.

In the exemplary embodiment shown in FIG. 1 boot lace 11 runs starting from winding mechanism 12 toward both flaps 7, 8 in a first, substantially horizontal section 11*a*, 11*l* to guide 13*a*, 13*b* attached to the particular flap 7, 8. From there the boot lace runs via curved second sections lib, ilk along guides 13*a*, 13*b* in order to pass from there into straight sections 11*c*, 11*j* running toward the middle of the tongue. These third sections 11*c* and 11*j* cross there on guide 14 attached to tongue 9, which guide is approximately opposite instep area F14 of the foot. The boot laces run from the second guide 14 as substantially horizontal fourth sections 11*d*, 11*l* to the outer back side of the boot to a third guide 15 located opposite upper heel area F15. The boot lace sections also cross each other on third guide 15 and run from there obliquely downward in fifth sections 11*e*, 11*h* to middle area 3 of sole 1. A fifth guide 16*a*, 16*b* in the form of a redirection is attached there in the exemplary embodiment of FIGS. 1–5 from which location a sixth section 11*f*, 11*g* runs obliquely upward to a sixth guide 17 attached to tongue 9 opposite instep area F14 and close to guide 14.

Sections 11*m*, 11*q* run obliquely to the front from sixth guide 17, on which the boot lace crosses itself again, in the direction toward front foot area 2 to the seventh guides 18*a*, 18*b* on flaps 7, 8 and from there via curved sections 11*n*, 11*p* to a last section 11*o* running substantially transversely over the front foot area and connecting the last-named sections 11*n*, 11*p* to each other.

The entire boot lace 11 is designed in one piece, that is, all cited sections 11*a*–11*q* are connected to each other.

Figure 2:
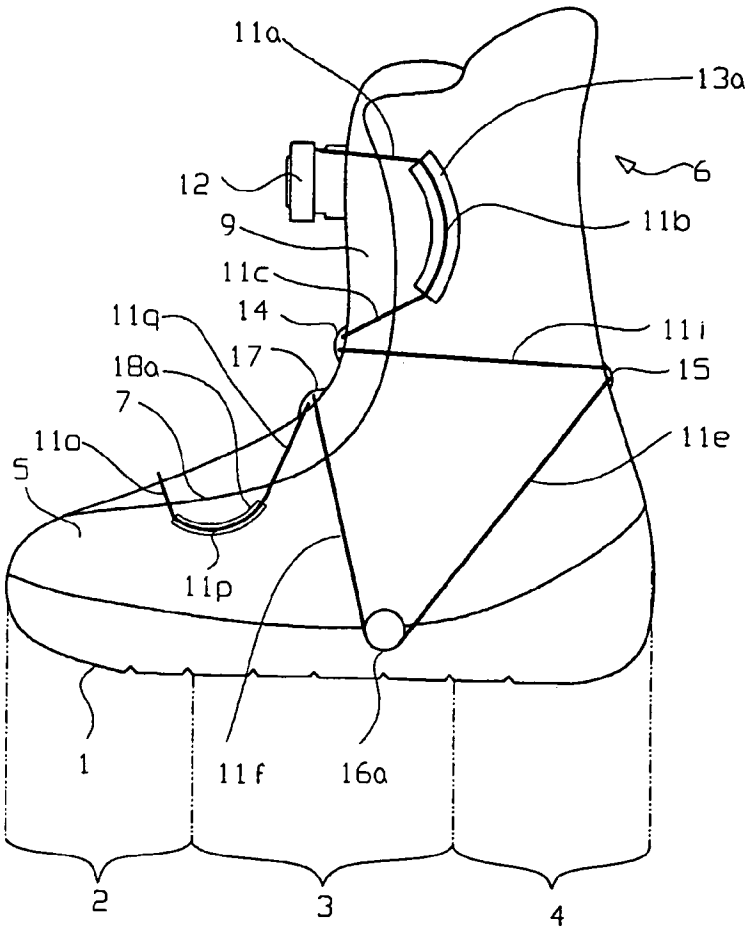
FIGS. 2–5 show a side view from the left, a rear view, a front view and a side view from the right of a boot lace in accordance with a first exemplary embodiment of the invention.
Figure 3:
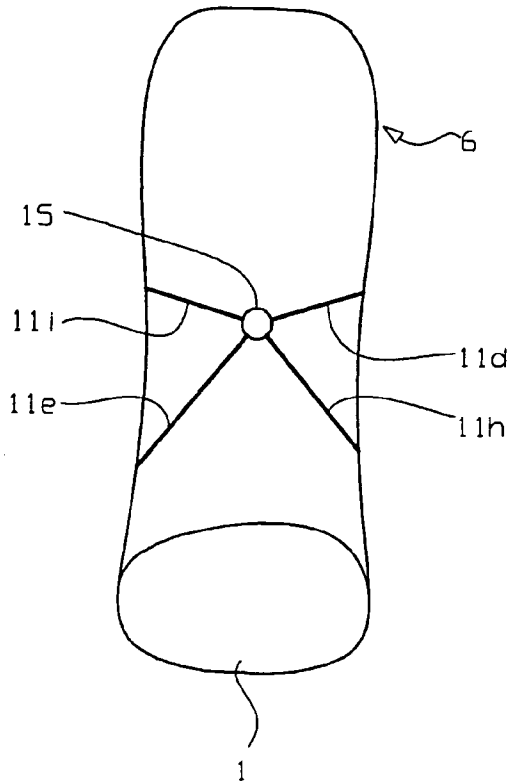
Figure 5:
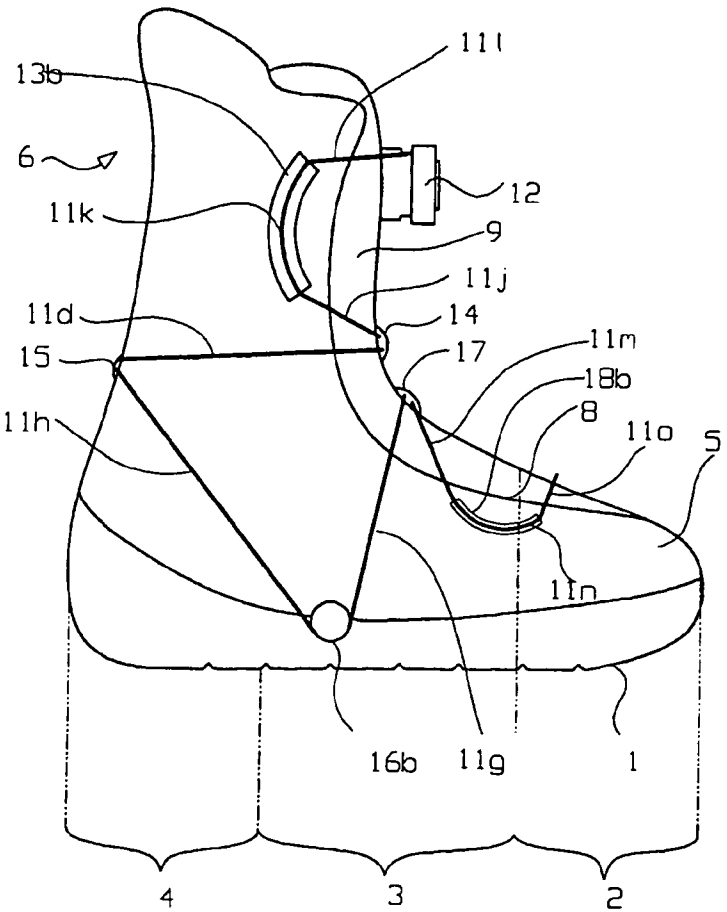

As FIGS. 1, 2 and 5 clearly show, sections 11*e*, 11*f*, 11*i* on the one side and 11*d*, 11*g* and 11*h* on the other side form a triangle that is substantially circumscribing the two ankle joints F2, F4 and therewith anklebone F3 in the projection of the side views (FIGS. 1, 2 and 5) and that is active between instep area F14, upper heel area F15 and metatarsal area F12 in such a manner that the boot lies closely on the foot, especially in critical upper heel area F15 and thus presses in particular the heel well downward against the sole and prevents it from lifting off the sole. Section 11*d* lies on the leg of the boot. At the same time the forces introduced into instep area F14 also counteract these undesired movements without binding the foot too greatly.

Boot lace 11 can slide on all guides 13–17 so that the lateral mobility of the upper, that is particularly desired when snowboarding, is given. This also makes it readily possible to tighten boot lace 11, especially if the guides preferably consist of material that has a low coefficient of friction in combination with boot lace 11. Therefore, metals and plastics are suitable for the guides.

The exemplary embodiment of FIGS. 6–10 differs from that of FIGS. 1–5 essentially in that the sections of boot lace 11 running to metatarsal area 3 of sole 1 each run through a bore with casing 19 and 20 transversely through sole 1 instead of being redirected via guides 16*a*, 16*b* attached at the side of the sole. This results in a different sequence of the sections in which the sections running through sole 1 cross each other, as can be recognized in FIG. 10. The sections running there are designated by reference numerals 11*r*, 11*s*. They can be guided in casings 19, 20 running substantially transversely through boot sole 1.

In the exemplary embodiment of FIGS. 1–5 the boot lace runs as follows, starting from winding mechanism 12:
section 11*a*-guide 13*a*-section 11*b*-section
11*c*-guide 14-section 11*d*-guide 15-section
11*e*-guide 16*a*-section 11*f*-guide 17-section
11*m*-guide 18*b*-section 11*n*-section 11*o*-section
11*p*-guide 18*a*-section 11*q*-guide 17-section
11*g*-guide 16*b*-section 11*h*-guide 15-section
11*i*-guide 14-section 11*j*-guide 13*b*-section
11*k*-guide 13*b*-section 11*l* back to means mechanism 12.

Sections 11*m*, 11*n*, 11*o*, 11*p* and 11*q* can also be eliminated if needed if a lacing is not necessary in the front foot area. In this instance section 11*f* merges directly via guide 17 into section 11*g*.

In the exemplary embodiment of FIGS. 7–10 the boot lace runs as follows, starting from winding device 12: section 11*a*-guide 13*a*-section 11*b*-section 11*c*-guide 14-section 11*d*-guide 15-section 11*e*-casing 20-section 11*r*-section 11*g*-guide 17-section 11*q*-guide 18*a*-section 11*p*-section 11*o*-guide 18*b*-section 11*n*-section 11*m*-guide 17-section 11*f*-casing 19-section 11*s*-section 11*h*-guide 15-section 11*i*-section 11*j*-section 11*k*-section 11*l* back to winding device 12. In this instance too sections 11*m*, 11*n*, 11*o*, 11*p* and 11*q* and guides 18*a*, 18*b* can be eliminated as required.

Figure 11:
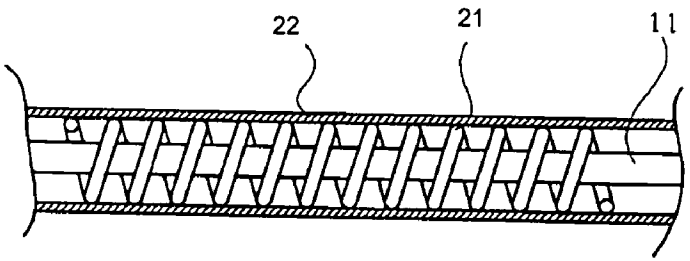
FIG. 11 shows a sectional view of a section of the boot lace.

If a thin wire with a diameter on the order of 1 mm or less is used as boot lace there is the danger that it can cut into the outer material, normally consisting of leather and/or textiles, of the laced boot during the tightening of the boot lace and also during subsequent usage. In order to protect against this, a few or all sections of the boot lace are guided in a protective jacket schematically shown in FIG. 11. This protective jacket can be, e.g., a wound spiral spring 21 in whose interior boot lace 11 slides. The spiral spring can additionally be surrounded with protective plastic jacket 22, as is known, e.g., for Bowden cables.

Figure 12:
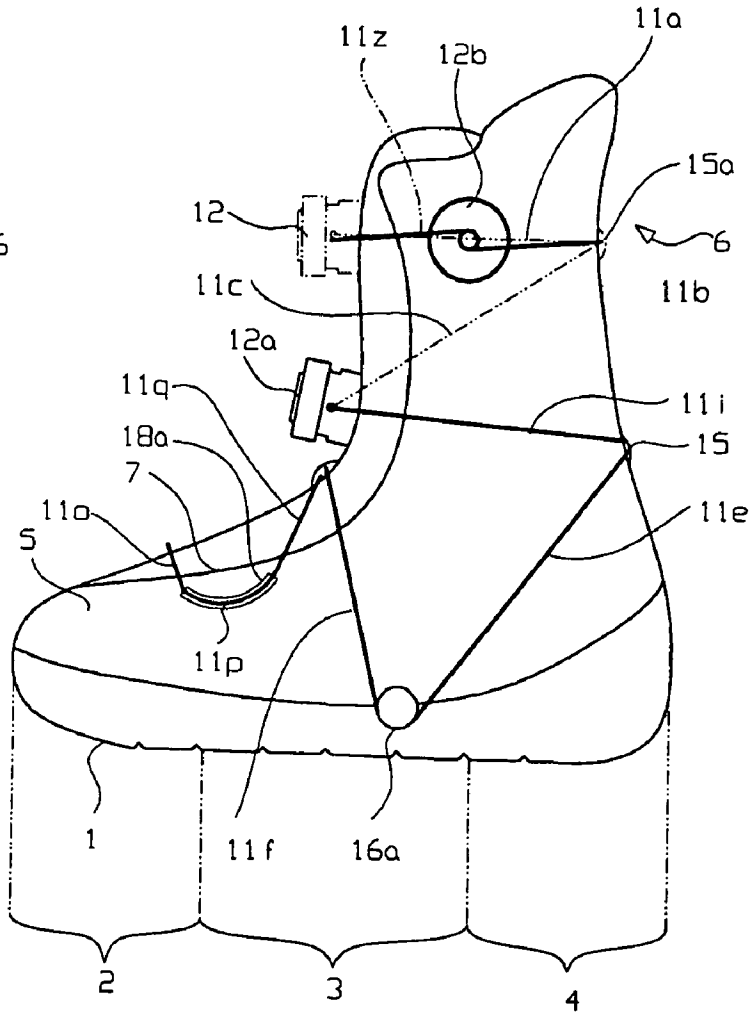
FIGS. 12 and 13 show a side view from the left and a rear view of a third exemplary embodiment of the invention.
Figure 13:
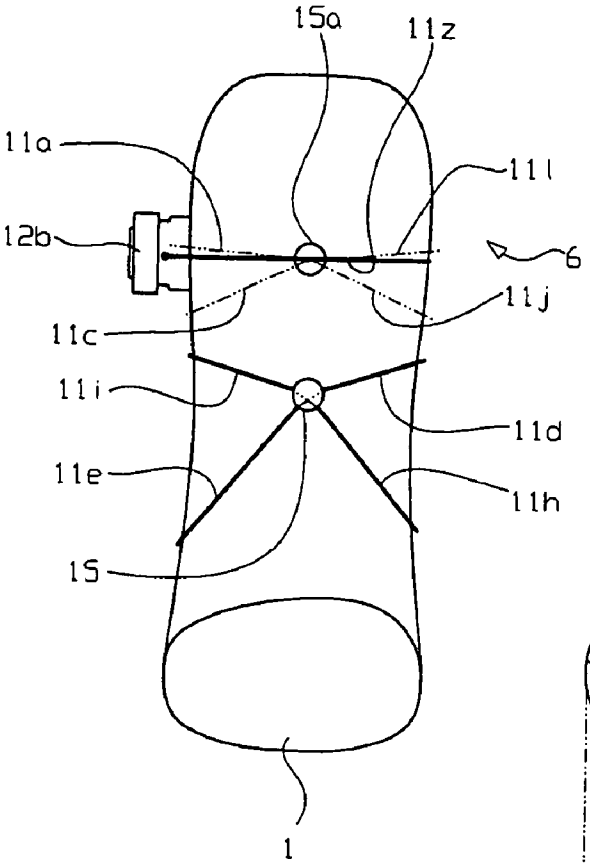

FIGS. 12, 13 show another exemplary embodiment of the invention with different alternatives. In the first alternative sections 11*c*, 11*j* running upward from guide 14 to leg 6 are run around the outside of leg 6, in distinction to the previous described exemplary embodiments, and cross one another on the back side of the upper in another guide 15*a*, from which they run substantially horizontally to the front to winding device 12 as indicated by dotted lines 11*c*, 11*j* as well as 11*a*, 11*b*. This makes the entire boot lace one-piece.

As an alternative to the above, the boot lace can also be divided. Sections 11*f*, 11*g*; 11*e*, 11*h*; 11*d*, 11*i* in accordance with the exemplary embodiments of FIGS. 1–10 are guided to a first winding device 12*a* arranged in the instep area of the boot and fastened on the tongue of the boot. A second boot lace 11*z* independent of the one cited above is guided substantially horizontally around the upper in the upper area of upper 6 and wound in a second winding device 12*b*. This winding device 12*b* can be attached on the side of upper 6, as can be seen in FIGS. 12, 13. However, it can also be attached in front on the tongue like winding device 12 of the previous exemplary embodiments.

In a corresponding manner the sections 11*o*, 11*p*, 11*q* tightening the area of the front foot can also form a separate boot lace with an additional winding device (not shown). It is essential that the three sections present on both sides of the boot that form the above-mentioned triangle form a one-piece boot lace that is tightened and locked by a winding device.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above methods and products without departing from the scope of the invention, it is intended that all matter contained in the above description and shown in the accompanying drawings shall be interpreted as illustrative and not in a limiting sense.

What is claimed is:

1. A laced boot comprising:

a sole comprising a front foot area, a metatarsal area, and a heel area;

an upper connected to the sole and comprising a toe area, an instep area, a leg, and a heel area;

and at least one boot lace carried on guides and comprising a first lace section running from the metatarsal area of the sole over the instep area of the upper, a second lace section running from the metatarsal area of the sole around the outside of the upper above the heel area, and a third lace section running from the upper above the heel area and above an upper ankle joint of a foot to the instep area;

wherein the three lace sections constitute a continuous single lace piece which, as viewed from the side, form a triangle which circumscribes ankle joints of a foot received in the boot and the first and the second lace sections are guided through at least one bore running transversely through the sole.

2. The laced boot of claim 1 wherein the first and the second lace sections are guided on both sides of the sole around redirections.

3. The laced boot according to claim 1 wherein the first and the second lace sections are guided through separate bores running transversely through the sole which cross one another in the inside of the sole.

4. The laced boot according to claim 3 wherein casings are arranged in the bores through which jackets corresponding to sections of the boot lace are guided.

5. The laced boot according to claim 1 wherein casings are arranged in the at least one bore through which jackets corresponding to sections of the boot lace are guided.

6. The laced boot according to claim 1 comprising a winding device in which the ends of the boot lace can be wound.

7. A laced boot comprising:

a sole comprising front foot area, a metatarsal area, and a heel area;

an upper connected to the sole and comprising a toe area, an instep area, a leg, and a heel area;

and at least one boot lace carried on guides and comprising a first lace section running from the metatarsal area of the sale over the instep area of the upper, a second lace section running from the metatarsal area of the sole around the outside of the upper above the heel area, and a third lace section running from the upper above the heel area and above an upper ankle joint of a foot to the instep area;

wherein the three lace sections constitute a continuous single lace piece which, as viewed from the side, form a triangle which circumscribes ankle joints of a foot received in the boot and at least a few sections of the boot lace are guided in flexibly elastic jackets.

8. The laced boot according to claim 7 wherein the flexibly elastic jackets are formed by wound spiral springs.

9. A laced boot comprising:

a sole comprising a front foot area, a metatarsal area, and a heel area;

an upper connected to the sole and comprising a toe area, an instep area, a leg, and a heel area;

and at least one boot lace carried on guides and comprising a first lace section running from the metatarsal area of the sole over the instep area of the upper, a second lace section running from the metatarsal area of the sole around the outside of the upper above the heel area, a third lace section running from the upper above the heel area and above an upper ankle joint of a foot to the instep area;

wherein the third lace section is followed by at least one fourth lace section that is guided over the upper and is connected in a one-piece manner to one of the first, second, or third lace sections and the lace sections constitute a continuous single lace piece which, as viewed from the side, form a triangle which circumscribes ankle joints of a foot received in the boot.

10. A laced boot comprising:

a sole comprising a front foot area, a metatarsal area, and a heel area;

an upper connected to the sole and comprising a toe area, an instep area, a leg, and a heel area;

at least one boot lace carried on guides and comprising a first lace section running from the metatarsal area of the sole over the instep area of the upper, a second lace section running from the metatarsal area of the sale around the outside of the upper above the heel area, and a third lace section running from the upper above the heel area and above an upper ankle joint of a foot to the instep area;

wherein the three lace sections constitute a continuous single lace piece which, as viewed from the side, form a triangle which circumscribes ankle joints of a foot received in the boot; and at least one fifth lace section guided over the upper part to the toe area and connected in a one-piece manner to one of the first, second, or third lace sections.

* * * * *